US005172971A

United States Patent [19]

Albiez

[11] Patent Number: 5,172,971

[45] Date of Patent: Dec. 22, 1992

[54] DRAWER

[75] Inventor: Alfred Albiez, Langen, Austria

[73] Assignee: Alfit Aktiengesellschaft, Götzis, Austria

[21] Appl. No.: 658,107

[22] Filed: Feb. 20, 1991

[30] Foreign Application Priority Data

Feb. 21, 1990 [AT] Austria ..... 395/90

[51] Int. Cl.[5] ..... A47B 88/00

[52] U.S. Cl. ..... 312/348.1; 312/330.1; 403/353

[58] Field of Search ..... 312/330.1, 348.1, 348.2; 403/279, 283, 353

[56] References Cited

U.S. PATENT DOCUMENTS

| | | | |
|---|---|---|---|
| 821,576 | 5/1906 | Athey . | |
| 1,936,733 | 11/1933 | Richardson | 312/330.1 X |
| 4,842,351 | 6/1989 | Rock et al. | 312/330.1 X |
| 4,875,747 | 10/1989 | Hollenstein | 312/330.1 |

FOREIGN PATENT DOCUMENTS

| | | | |
|---|---|---|---|
| 379497 | 1/1986 | Austria . | |
| 388651 | 8/1989 | Austria . | |
| 0322545 | 11/1988 | European Pat. Off. . | |
| 2702217 | 7/1978 | Fed. Rep. of Germany | 312/348.1 |
| 8634281 | 3/1987 | Fed. Rep. of Germany . | |
| 3641325 | 6/1988 | Fed. Rep. of Germany . | |
| 3702238 | 8/1988 | Fed. Rep. of Germany . | |
| 3805669 | 9/1988 | Fed. Rep. of Germany . | |
| 3711063 | 10/1988 | Fed. Rep. of Germany . | |
| 2169491 | 7/1986 | United Kingdom . | |
| 2203632 | 10/1988 | United Kingdom . | |

*Primary Examiner*—Kenneth J. Dorner
*Assistant Examiner*—Brian K. Green
*Attorney, Agent, or Firm*—Collard & Roe

[57] ABSTRACT

A drawer is limited on its sides by metal side walls provided at their top with guide rails and at the bottom with a carrying flange for supporting a bottom plate of the drawer. The carrying flange is formed with stamped-out, flat retaining lugs bent up to extend from below into openings of the bottom plate, which drawer also comprises a rear wall mounted between the side walls. In order to permit a reliable, simple and optionally automatic mounting of the bottom plate, the retaining lugs extend transversely to the longitudinal direction of the flange and into the openings to hold the bottom plate against longitudinal and transverse displacements. A hook-shaped holding-down member is stamped out from the forward end portion of the carrying flange and extends into a recess provided in the front end face of the bottom plate, and the rear wall of the drawer is secured to the side walls and is arranged to hold down the bottom plate at its rear end portion, which extends under the rear wall.

3 Claims, 2 Drawing Sheets

1
2
3
4
5
6
7
8
9
10
11
12
13
14
15
16

DRAWER

BACKGROUND OF THE INVENTION

1. Field of the Invention

This invention relates to a drawer, which has metal side walls, delimiting the interior of the drawer on its sides and provided at their top with guide rails, which constitute a part of an extension guide for the drawer, and which have a bottom carrying flange for supporting a bottom plate of the drawer, which carrying flange has stamped out retaining lugs bent up to extend from below into openings of the bottom plate. The drawer also comprises a rear wall mounted between the side walls.

2. Description of the Prior Art

In such drawers the side walls have a multiple function because they limit the drawer on its sides and constitute a part of the extension guide for the drawer and also serve to hold the rear wall of the drawer and optionally to hold a front wall which is provided in most cases in the drawer. The extension guide for the drawer may additionally comprise rollers, which are provided on the side walls and cooperate with guide rails, which are mounted on the body of the furniture. The rear wall of the drawer is usually mounted in such a manner that said rear wall extends as close as possible to the flanges of the side walls of the drawer and the bottom plate abuts the rear wall. The front wall is preferably fixed by means which are as independent as possible from the means for fixing the bottom plate and may comprise adjustable retaining means so that when the drawer has been mounted in a piece of furniture it will be possible to adjust the inclination of the front wall and preferably to make an adjustment to provide gaps of equal width between the front wall and the opening by which the drawer is received or to provide an equal spacing between the edges of the front plate and adjacent drawers.

It is known that the bottom plate may be secured by means of the retaining lugs alone. It has been disclosed in British Patent Specification 2,169,491 that for this purpose the retaining lugs may be bent up about bend lines which are parallel to the longitudinal direction of the flange, the lug-receiving openings are combined to form continuous grooves, which are formed in the bottom plate and are parallel to its edges, and the height of the bent-up retaining lugs is selected to slightly exceed the depth of the narrow groove, which is substantially adapted to the thickness of the lugs, so that the retaining lugs will bite into the bottom of the groove as the bottom plate is forced onto the lugs. But that arrangement will not ensure a satisfactory anchoring of the retaining lugs in the groove so that a lifting of the bottom plate and even a displacement of the bottom plate along the groove will not reliably be prevented. In German Utility Model 86 34 281 it is taught that for this reason in a similar arrangement each retaining lug should be provided at its top with a harpoonlike profile, which will bite into the side face of the groove as the bottom plate is forced onto the retaining lugs. In that case the harpoon head may damage the edge of the groove, the end position of the bottom plate relative to the side walls is not predetermined and the bottom plates may come loose in prolonged use. For this reason it has been proposed in U.S. Pat. No. 4,875,747 that the groove in the bottom plate should be somewhat wider and the correspondingly stamped out retaining lugs should be bent up about bend lines which extend at an acute angle to the longitudinal direction of the flange so that the lugs extend obliquely to the groove and their longitudinal edges will bite into the side faces of the groove as the bottom plate is forced onto the lugs. In all designs which have been described hereinbefore it is possible to fix the bottom plate by simply pressing it against the flanges so that the retaining lugs enter the groove and the assembling is facilitated. But even in the last-mentioned design a lifting of the bottom plate from the carrying flanges is not reliably prevented and the position of the bottom plate which has been forced onto the carrying flanges is not exactly defined so that the use of assembling machines may result in relatively large deviations regarding the fixation of the bottom plate on the side walls. In order to avoid said disadvantages it has been proposed in Published German Application 37 11 063 that retaining lugs should be used which have been bent up parallel to the longitudinal direction of the flange and in order to prevent a displacement in the longitudinal direction should enter associated recesses in the bottom plate and that the bottom plate should be held down forming the side walls above the inserted bottom plate with longitudinal grooves and placing an elastically deformable plastic sheeting on the bottom plate. The plastic sheeting has a protruding edge portion, which snaps into said longitudinal grooves so that said sheeting will hold down the bottom plate. But that design can be used only when the sheeting has been applied and is expensive.

Other means for preventing a lifting of the bottom plate are known from Austrian Patent Specification 388,651 and from Published German Application 38 05 669. In said case the retaining lugs are provided with end claws and are bent up only to such an extent that when the bottom plate has been applied said lugs can be forced into recesses or into a continuous groove formed in the bottom plate. In that case a separate operation requiring special tools, such as pliers, must be performed to bend the lugs further when the bottom plate has been applied so that the claws are then forced into at least one side face of the groove. It is virtually impossible to automate that operation and the afterbending may damage the bottom plate or the retaining lugs and particularly may damage a coating possibly provided on the side walls and retaining lugs so that the side walls if made from a material which does not resist rusting or corrosion may exhibit nonpermissible rust where the side walls are in contact with the lugs. Inter alia, from German Published Application 36 41 325 it is known that the rails of extension guides for the drawers may be secured to the drawer by means of hook-pin joints in an arrangement in which a bent-up hook is provided at the rear end of the guide rail and a pin is provided at the front end, an opening for receiving the hook is formed in the rear wall of a drawer box and an opening for receiving the pin is provided in an edge face of a side wall of the drawer box. In that case the drawer box and the guide rails may be joined in a modular assembly by means of plug joints composed of the stated elements and the plug joints may subsequently be fixed by additionally provided screw joints. If a shorter drawer is to be accommodated in a deeper compartment it will be possible to mount spacers on the guide rails and said spacers may be fixed to the bent-up hooks and may be used to hold down the short drawer by means of a plugged-in pin. It is also known to use a hook-pin joint for the fixation of a wire basket used instead of a drawer box. It is also known from British Patent Specification 2,203,632 to provide a hook-pin joint that comprises a hung-in hook provided at one end of a retaining rail that can be secured to the furniture corpus and a pin that is provided at the other end of the rail and to use that joint for a fixation to the furniture corpus of an extension guide comprising a rail and rollers. Published German Application 37 02 238 discloses the provision of a hook at the rear end of a guide rail to hold down the rear end of a drawer box. In accordance with Austrian Patent Specification 379,497 the corpus rail of an extension guide for a drawer is fixed by a retaining bar, which is provided at its rear end with a hook that has an end leg which has been bent up to extend parallel to a carrying flange, the bar is provided with bent-up retaining lugs spaced from said hook, and the corpus rail has a notch for facilitating the insertion of the hook and openings for receiving the retaining lugs.

It is also known from U.S. Pat. No. 821,576 that the box of a drawer may be assembled from an outer skin of sheet metal and of bottom and wall plates secured to said skin. That outer skin may also extend upwardly over the rear wall of the drawer and has a bent-down top edge portion for retaining a plate which constitutes the rear wall and has bottom edge resting on the bottom plate.

SUMMARY OF THE INVENTION

It is an object of the invention to provide a drawer which is of the kind described first hereinbefore and in which simple means, which permit an automatic assembling, are used to ensure an exact positioning of the bottom plate relative to the carrying flanges and a reliable fixation of the bottom plate in the correct position.

The object set forth is accomplished with flat retaining lugs that are bent up to extend transversely to the longitudinal direction of the flange and to engage respective openings on the bottom plate in a clamping fit to hold the bottom plate against longitudinal and transverse displacements. A hook-shaped holding-down member is stamped-out, from the forward end portion of the carrying flange and engages the bottom plate at its front end face and extends into a recess provided in the front end face of the bottom plate, and the rear wall of the drawer is adapted to be secured to the side walls and is arranged to hold down the bottom plate at its rear end portion, which extends under said rear wall.

A lifting of the bottom plate is prevented by the hook-shaped holding down members and by the rear wall of the drawer and the bottom plate is held in the correct position by the flat retaining lugs. Only simple movements are required during the assembly so that possibly with the exception of the fixation of the rear wall of the drawer the entire operation to mount the bottom plate may be automated. The retaining lugs may be relatively short and have a simple shape so that the side walls can be stacked and shipped in a compact arrangement. Owing to the simple shape the means for retaining the bottom plate may also easily be made.

According to a further feature of the drawer in accordance with the invention the bottom plate is formed in its front end face with a stepped bore or with a bore that extends from a recess formed in the underside of the bottom plate and the hook-shaped holding-down member is adapted to be inserted into said bore when the bottom plate is included towards the carrying flange. In that design the hook-shaped holding-down members are inserted and the bottom plate is then swung down onto the carrying flange so that the retaining lugs enter the openings in the bottom plate. Thereafter the rear wall of the drawer is mounted. The front plate may protrude over the hook-shaped holding-down member, e.g., as far as to the end of the side wall, and the surface with which the bottom plate is supported within the free space of the drawer will not be disturbed by the hook-shaped holding-down member. With that design it is most simple to mount the bottom plate in the proper position.

Further details and advantages of the invention will become apparent from the following description of the drawing.

DETAILED DESCRIPTION OF THE PREFERRED EMBODIMENT

Figures 1, 2, 3:
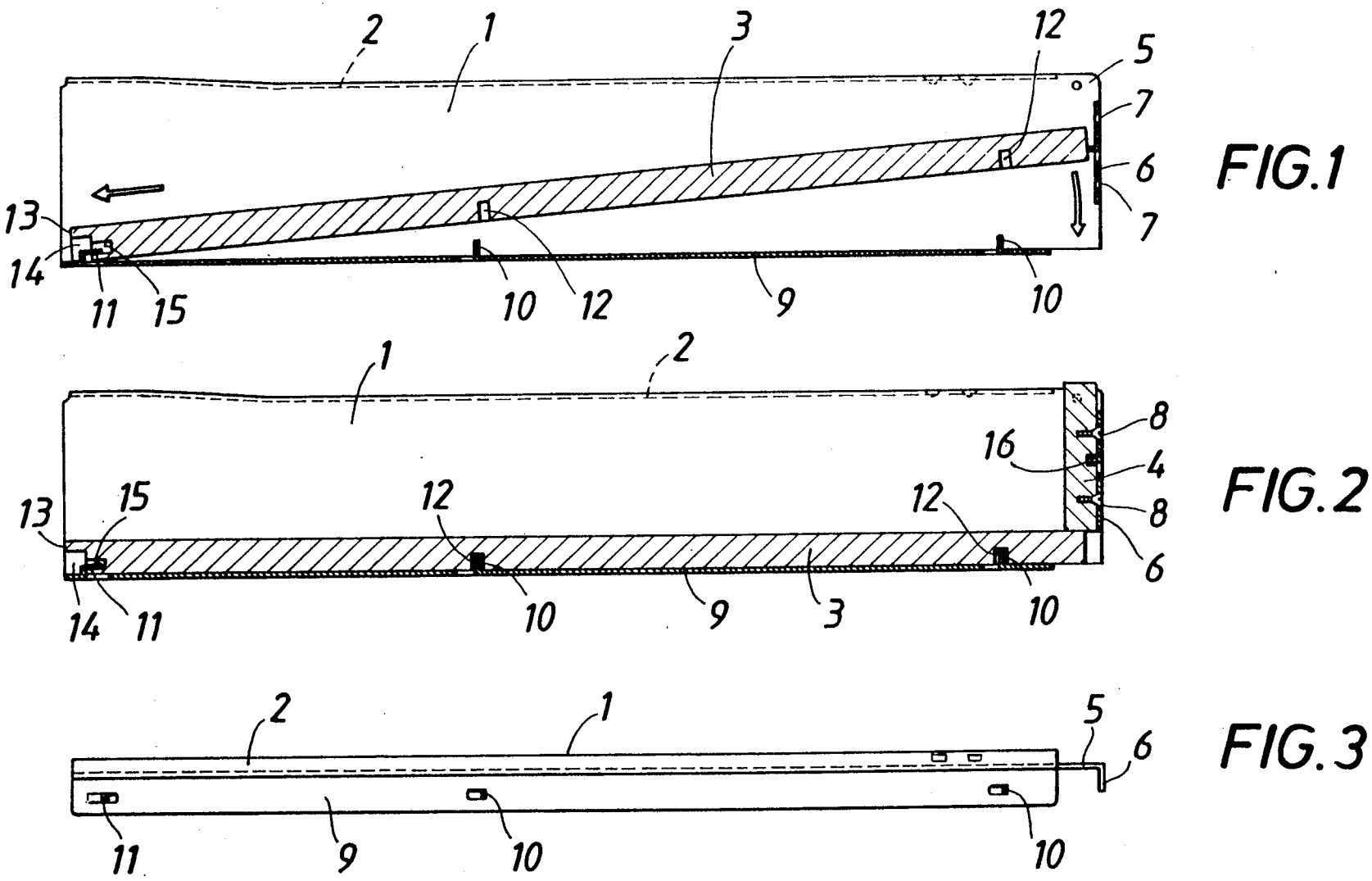
FIG. 1 is an inside view showing a side wall of a drawer and a longitudinal sectional view showing a bottom plate as it is mounted.
FIG. 2 is a view which is similar to FIG. 1 and the mounted bottom plate and shows the rear wall of the drawer in longitudinal section.
FIG. 3 is a top plan view showing the side wall.
Figure 4:
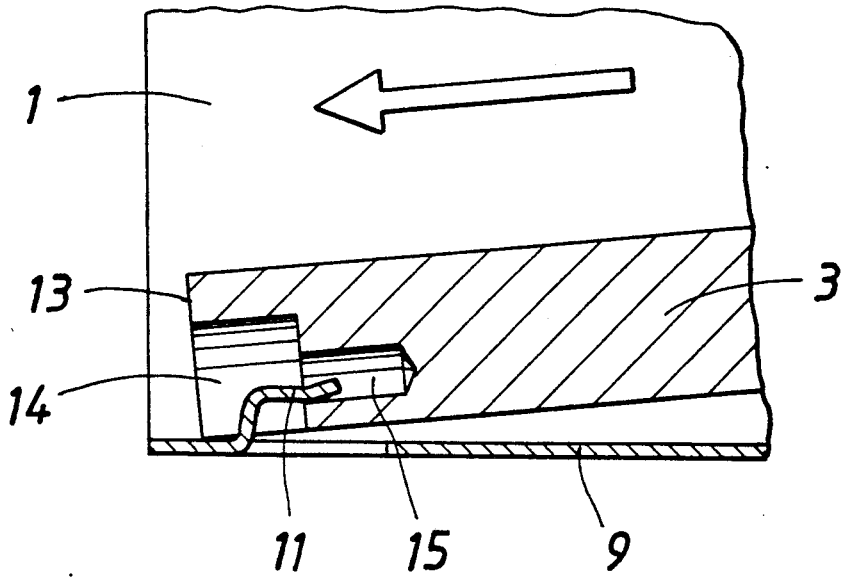
FIGS. 4 and 5 show on an enlarged scale details of FIG. 1 adjacent to the hook-shaped holding-down member and to a retaining lug.
Figure 5:
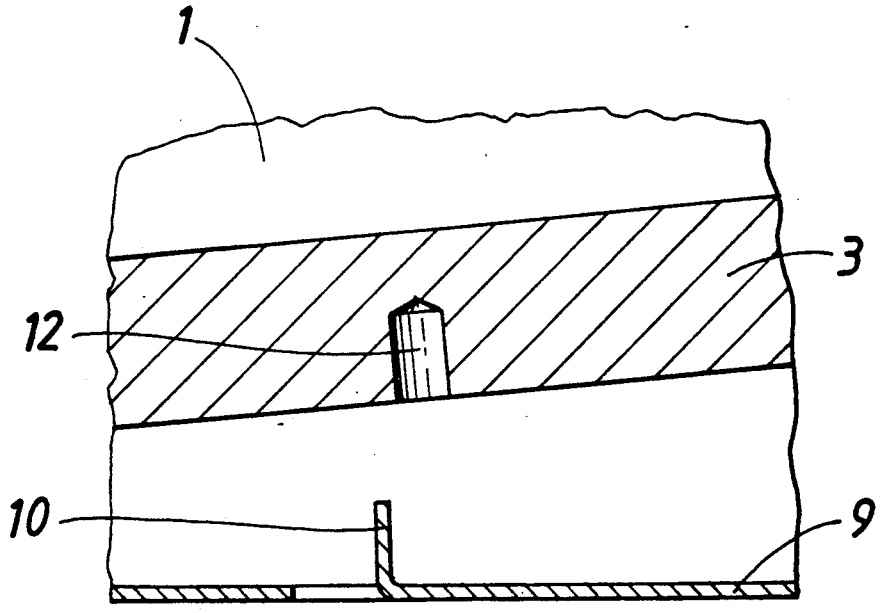

In the embodiment illustrated by way of example in the drawing the drawer comprises two metal side walls 1, each of which has a flange at its top to provide a guide rail 2, which constitutes a part of a known guide for extending the drawer. The side walls 1 delimit the interior of the drawer on its sides. That interior is confined at the bottom by a bottom plate 3 and at the rear by a rear wall 4 of the drawer. An individually adjustable front plate, not shown, is normally mounted at the front end of the drawer and may be provided with a handle. The bottom plate 3 may consist of a wood material or may be made of a different material, such as injection-molded plastic. An extension 5 provided with a retaining flange 6 projects from the web of the side wall 1, and flange 6 has openings for receiving screws 8 for securing the rear wall 4 of the drawer to the retaining flange.

The side wall 1 also has a bottom flange 9 for carrying the bottom plate 3. Short retaining lugs 10 are stamped out of that carrying flange and are bent up. Close to the front end of the carrying flange 9 a further lug is stamped out of the carrying flange 9 and just as the retaining lugs 10 has been bent up to extend transversely to the longitudinal direction of the flange and this front lug has a top flange to form a hook-shaped holding-down member 11. The free end of said hook may slightly be bent up to facilitate its insertion.

The bottom plate has an underside and lateral portions extending between front face 13 and the rear end of the bottom plate adjacent bottom flanges 9 of side walls 1. The lateral bottom plate portions define openings 12 in the underside of the bottom plate for receiving the retaining lugs 10. The bottom plate 3 is formed in its forward end face 13 with a stepped bore 14, 15. The enlarged outer portion 14 of the bore facilitates the insertion of the hook-shaped holding-down member 11 whose free end may be slightly bent up to facilitate the insertion.

As is apparent from FIG. 1 the bottom plate can be pushed to receive the hook-shaped holding-down members 11 when the bottom plate 3 is downwardly inclined with respect to the carrying flange 9 toward the front end face 13. During that operation the enlarged outer portion 14 of the bore will facilitate the insertion and the holding-down member 11 will then enter the bore 15. The shoulder between the bores 14, 15 constitutes a stop for the upstanding portion of the hook-shaped holding-down member 11. As the bottom plate 3 is swung from the position shown in FIG. 1 to the position shown in FIG. 2 the retaining lugs 10 will enter the openings 12 to clamp the bottom plate to the carrying flanges. As a result, the bottom plate has been fixed against longitudinal and transverse movements relative to the side walls 1 and is locked at its front end by the hook-shaped holding-down member 11 against being lifted. When the rear wall 4 of the drawer has been mounted over the end portion with which the bottom plate 3 extends under the rear wall 4, the bottom plate 3 has been fixed also at its rear against being lifted from the carrying flange 9 so that the entire bottom plate has durably been secured in its proper position. The rear wall 4 of the drawer may also be formed with a bore 16 for receiving an adjusting lug, which has been bent up from the retaining flange 6.

I claim:

1. A drawer comprising:

(a) two metal side walls laterally delimiting an interior of the drawer, each side wall having (1) a top flange bent laterally outwardly to constitute a guide rail and (2) a bottom flange bent laterally inwardly, (3) the flanges extending in a longitudinal direction and the bottom flange having a plurality of stamped-out and upwardly bent, flat retaining lugs spaced from each other in the longitudinal direction and extending substantially perpendicularly to the longitudinal direction, (b) a bottom plate extending between the side walls and having an underside supported on the bottom flanges, the bottom plate having a front face, a rear end and lateral portions extending between the front face and the rear end adjacent the bottom flanges of the side walls, (1) the front face of the bottom plate defining recesses in alignment with the bottom flanges of the side walls, (2) the bottom flanges having stamped-out and upwardly bent, hook-shaped holding-down members engaging the recesses in the front face of the bottom plate, and (3) the lateral portions defining openings in the underside of the bottom plate, the openings extending substantially perpendicularly to the longitudinal direction and receiving respective ones of the flat retaining lugs in a clamping fit whereby the retaining lugs hold the bottom plate against displacement, and (c) a rear wall extending between the side walls and secured thereto, the rear wall extending over the rear end of the bottom plate and holding the bottom plate rear end on the bottom flanges.

2. The drawer of claim 1, wherein the recesses in the front face of the bottom plate are stepped bores engaged by the holding-down members.

3. The drawer of claim 1, wherein the recesses in the front face of the bottom plate comprise a portion recessed from the front face and extending to an underside of the bottom plate and a bore extending from the recessed portion in the longitudinal direction.

* * * * *